US005890350A

United States Patent [19]

Tisma

[11] Patent Number: 5,890,350

[45] Date of Patent: Apr. 6, 1999

[54] AUTOMATIC PACKAGING MACHINE FOR MULTIPLE SMALL ITEMS WITH DESIRED ORIENTATION

[75] Inventor: Steven Tisma, Elk Grove Village, Ill.

[73] Assignee: Tisma Machinery Corporation, Elk Grove Village, Ill.

[21] Appl. No.: 848,127

[22] Filed: Apr. 28, 1997

Related U.S. Application Data

[60] Provisional application Nos. 60/017,757 May 16, 1996 and 60/018,296 May 24, 1996.

[51] Int. Cl.[6] ..... B65B 35/54

[52] U.S. Cl. ..... 53/543; 53/247; 53/251; 53/252; 53/255; 53/258; 53/566; 53/534; 53/544; 53/494; 53/495; 53/498; 53/501

[58] Field of Search ..... 53/54, 154, 155, 53/237, 238, 247, 255, 258, 260, 250, 251, 252, 446, 494, 495, 498, 499, 500, 501, 504, 566, 533, 534, 543, 544

[56] References Cited

U.S. PATENT DOCUMENTS

| | | | |
|---|---|---|---|
| 2,827,148 | 3/1958 | Engelson et al. | 53/154 X |
| 3,389,531 | 6/1968 | Ehe et al. | 53/155 |
| 3,994,324 | 11/1976 | Eisenberg | 53/237 X |
| 4,094,129 | 6/1978 | List | 53/493 X |
| 4,094,439 | 6/1978 | List | 53/493 X |
| 4,211,055 | 7/1980 | Long et al. | 53/252 |
| 4,248,027 | 2/1981 | Cleary et al. | 53/244 |
| 4,265,072 | 5/1981 | Egli | 53/544 X |
| 4,304,085 | 12/1981 | Ross | 53/534 X |
| 4,408,295 | 10/1983 | Kavage et al. | 53/494 X |
| 4,674,259 | 6/1987 | Hills | 53/247 X |
| 4,680,464 | 7/1987 | Bross | 53/57 X |
| 4,817,779 | 4/1989 | Beck et al. | 53/252 X |
| 4,829,751 | 5/1989 | Tisma | 53/252 X |
| 4,982,556 | 1/1991 | Tisma | 53/154 X |
| 5,010,713 | 4/1991 | Leander | 53/544 X |
| 5,185,984 | 2/1993 | Tisma | 53/252 |
| 5,323,587 | 6/1994 | Amarahti | 53/258 X |
| 5,570,562 | 11/1996 | Anderson | 53/252 X |
| 5,657,610 | 8/1997 | Dietrich et al. | 53/252 X |

*Primary Examiner*—Daniel B. Moon
*Attorney, Agent, or Firm*—Laff, Whitesel, Conte & Saret, Ltd.

[57] ABSTRACT

An automatic packaging machine inserts small items, such as candy coated chewing gum, into a box with the small items arranged in a desired orientation. First, the small items are swept into a grid of individual pockets in plates on a conveyor. Then, the grid is inverted over an insertion tray having grooves which receive the small items without disturbing the desired orientation. The entire tray is inserted into a box and then withdrawn from the box. A ridge is formed adjacent said grooves for lifting a side of the box confronting the small items while the tray is inserted into the box so that there is almost no friction between the small item and the box, which might otherwise disturb the desired orientation. The small items are blocked during a withdrawal of the tray so that they are laid down in the desired orientation on the bottom of the box.

28 Claims, 11 Drawing Sheets

120
125
124
108
122
93
96
115
88
92
90

AUTOMATIC PACKAGING MACHINE FOR MULTIPLE SMALL ITEMS WITH DESIRED ORIENTATION

This is a formal application replacing provisional application Ser. No. 60/018,296, filed May 24, 1996, now abandoned, which was, in turn, a continuation-in-part of provisional application Ser. No. 60/017,757, filed May 16, 1996 now abandoned.

This invention relates to automatic packaging machines and more particularly to machines for placing small items inside a container, with the small items arranged in a desired orientation.

BACKGROUND

Candy coated chewing gum (such as that sold under the trademark "CHICLETS") is an example of small items which are packaged by the inventive machine. For convenience of expression, these and similar items are hereinafter called "small items."

One characteristic of these small items is that they should be laid out in an orderly, side-by-side orientation within a box or other container. They should be counted so that each and every box contains exactly the correct number of items. They should be treated gently because they may break, if handled roughly; for example, the candy coating on "CHICLETS" is likely to break. Finally, as the small items are handled by the packaging machines on the way to the carton, little bits and debris of the broken candy coating, in the example of "CHICLETS" tend to accompany the small items. These debris should be sifted out of the product stream so that only whole and unbroken small items are packaged.

Another problem is that traditional packaging machines push the product into the box or other container. If the small items of the described type are so pushed, they tend to lose their orientation so that those in the front may become disoriented causing those behind to pile up and jam or break.

Still other problems will occur to those skilled in the art.

SUMMARY

Accordingly, an object of this invention is to overcome these and similar problems.

In keeping with an aspect of the invention, an incoming feed stream of small items are dumped into a heap at a start position. The heap grows to a level monitored by a sensor. A conveyor formed by a sequential plurality of plates, each having a grid of pockets, pass under the heap to collect the small items in the pockets. From there, the conveyor carries the plates having the grid of pockets under brooms which sweep any loose small items carried on the surface of the plates back toward the heap. The sweeping also causes the small items to fill the pockets in an orientation that they will have in the carton. The filled pockets are next deposited into twin grooves on an insertion tray in a manner which preserves the orientation which the small items had while in the pockets. A narrow light beam scans over the small items while in the insertion tray, so that each individual small item reflects light which is sensed as a pulse. The pulses are counted and analyzed to confirm that the correct number of small items are on the tray and are in the proper orientation. Then the entire insertion tray, with the small items in the grooves, is inserted into a box. A stripper fits into the grooves so that as the tray is withdrawn from the box, the small items are left in the box.

DESCRIPTION OF THE DRAWINGS

The invention may be understood best by making a reference to the following specification taken in connection with the attached figures, in which:

FIG. 9A is a perspective view of a track section and an insertion tray;

DETAILED DESCRIPTION

Figure 1:
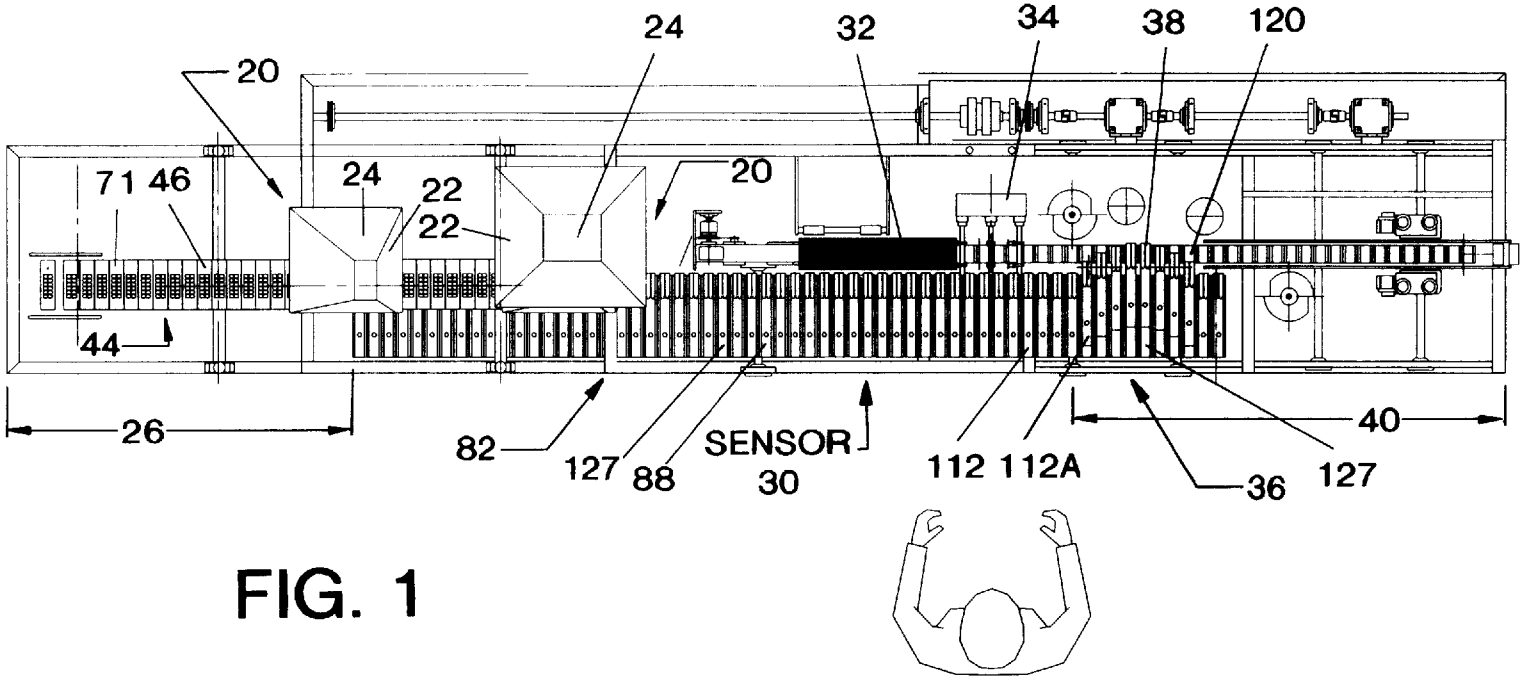
FIG. 1 is a plan view showing the inventive packaging machine.
Figure 2:
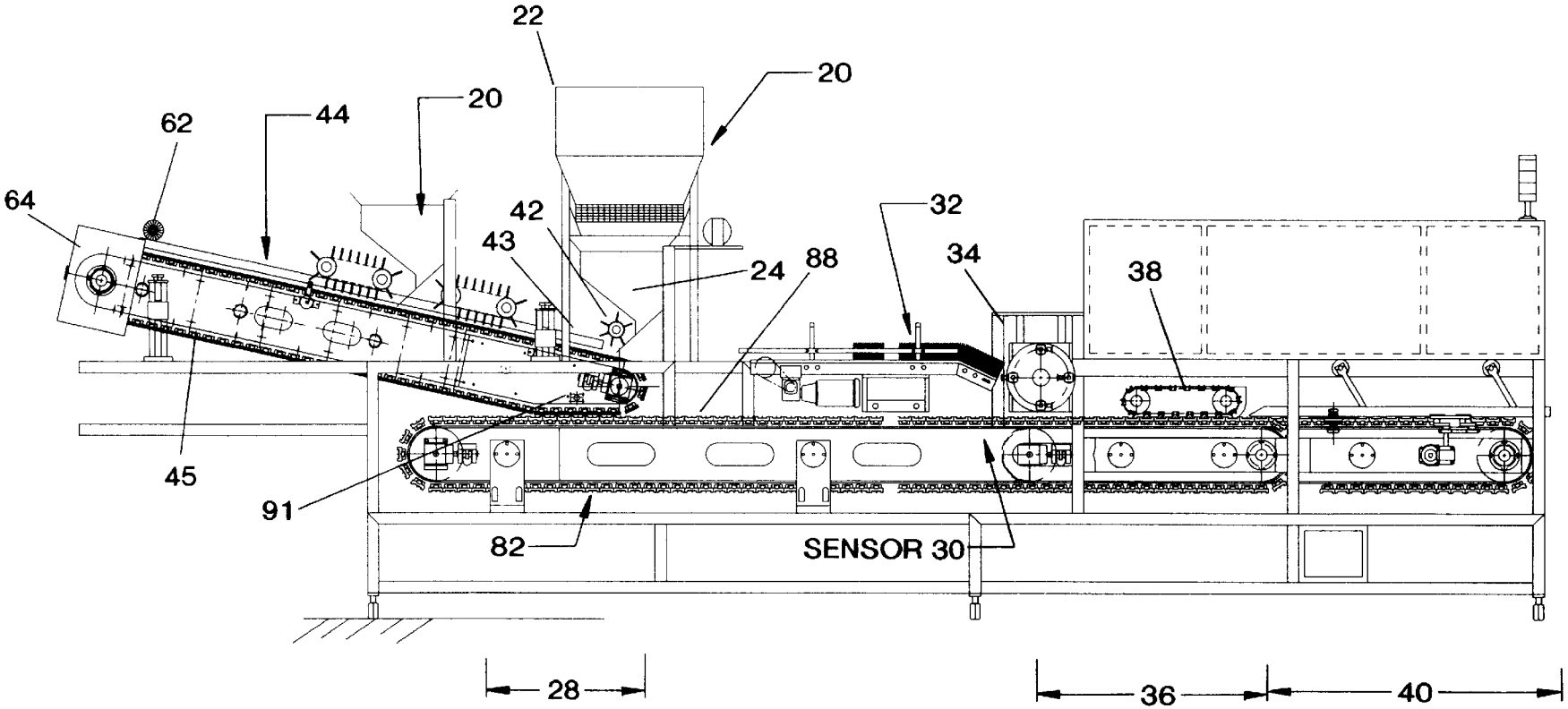
FIG. 2 is an elevation of the packaging machine of FIG. 1.

FIGS. 1 and 2 show the entire automatic packaging machine having an input 20 in the form of a hopper 22 with a trough or chute 24 for feeding small items to a loader position in a small item orientation section 26. As here shown, there are two such hoppers to insure that all pockets are filled, in case they were not filled as they are loaded from a first hopper. The oriented small items are laid down on insertion trays in an area 28 (FIG. 2). At 30, a sensor counts the small items in the insertion trays to be sure that exactly the correct number is deposited in each carton.

Cartons blanks are stored in a magazine 32 to be formed into boxes in an area 34. At location 36, the small items are resting on an insertion tray so that they can be inserted into the formed cartons. A stripper 38 causes the small items to remain in the carton as the insertion tray is withdrawn from the carton. From there, the cartons are sealed and discharged in area 40, in a conventional manner. Note, the small items are carried and not pushed into the carton.

Figure 4:
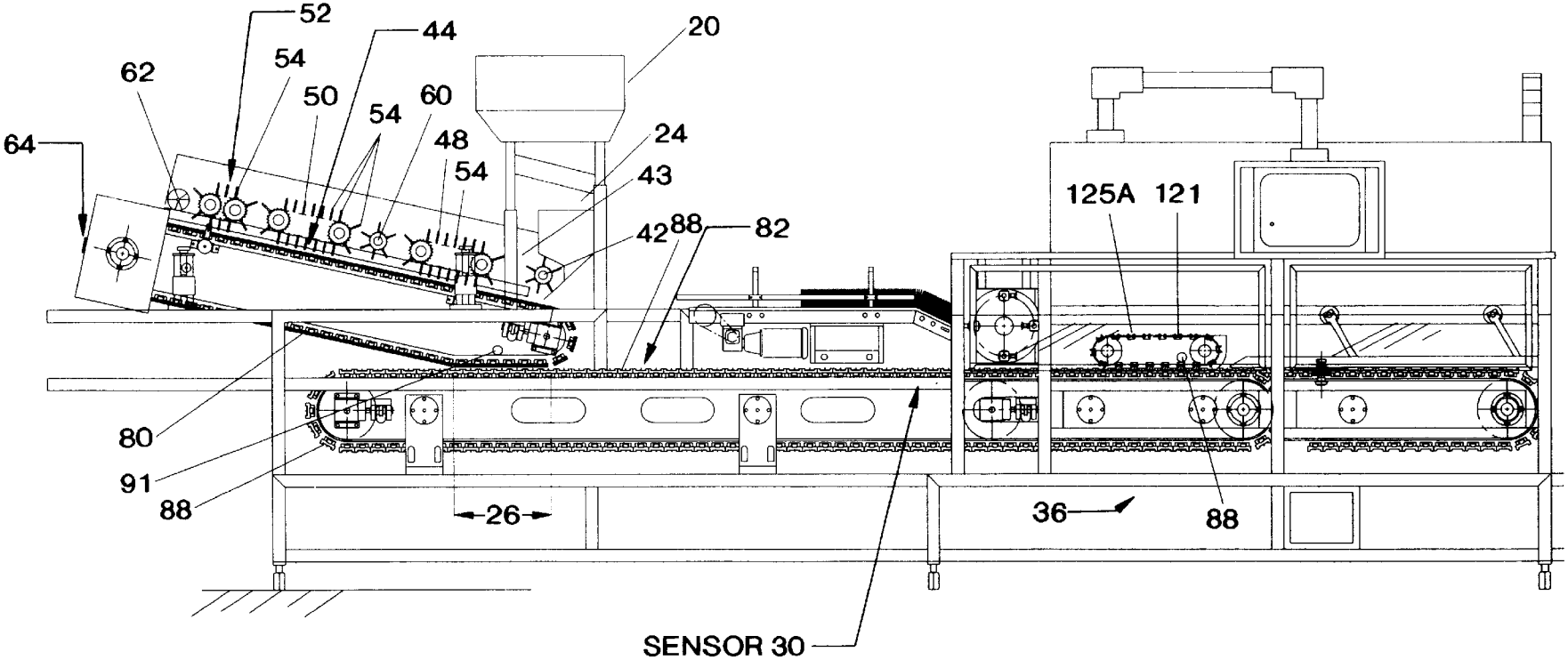
FIG. 4 is an enlarged elevation of the inventive end of the packaging machine of FIG. 2.
Figure 5:
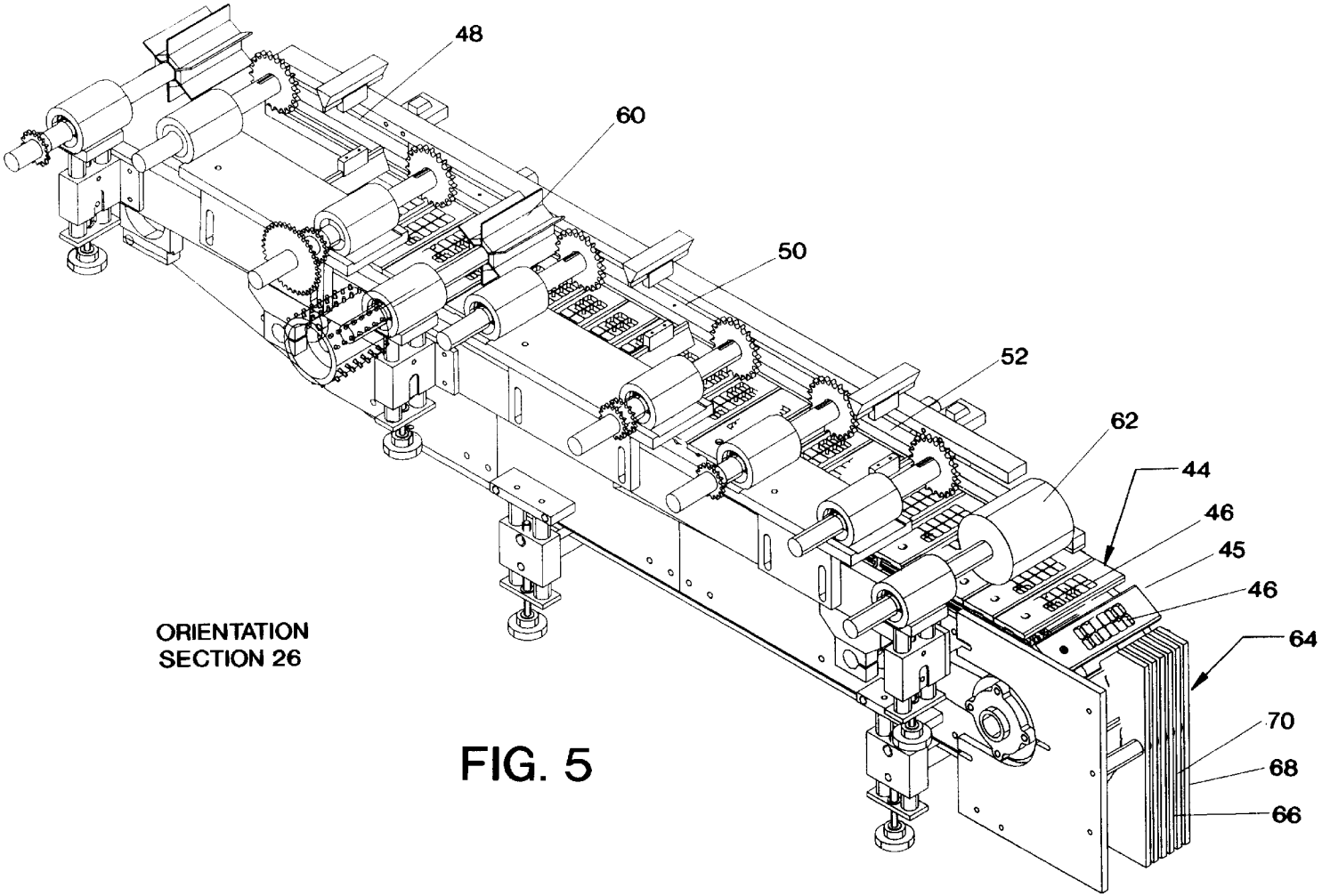
FIG. 5 is a perspective view taken from the back of the orientation conveyor of FIG. 4.

The orientation section 26 is shown in greater detail in FIG. 4. FIG. 5 shown the orientation section 26 in perspective. The parts can be identified by comparing reference numerals in the various figures.

The small items are initially placed in hoppers 22 in any suitable manner, as for example by a conveyor carrying product from the output of a manufacturing process. The small items flow into pockets in a metering wheel 42 (FIG. 4) which turns until a sensor 43 detects a heap of small products, piled up to a suitable height.

Means are provided for arranging the small items in an orientation corresponding to the orientation that they will have in a carton. More particularly, a conveyor 44 is formed by a plurality of elongated spaced parallel pocketed plates 45 (FIG. 5) joined to a link chain. Each plate has a plurality of pockets 46 arranged in an orientation which corresponds to an expected orientation of the small items inside a carton. Here the pockets are in the form of a grid having two columns and five or six rows; however, other arrangements may also be used. The pockets may be frames with an open bottom so that the small items are captured by the frames while debris, such as broken bits of a candy coating, fall through the open bottom. The object is to fill each pocket with a single small item in a correct orientation and to place the rows and columns of small items inside the carton in the corresponding orientation.

Figure 6:
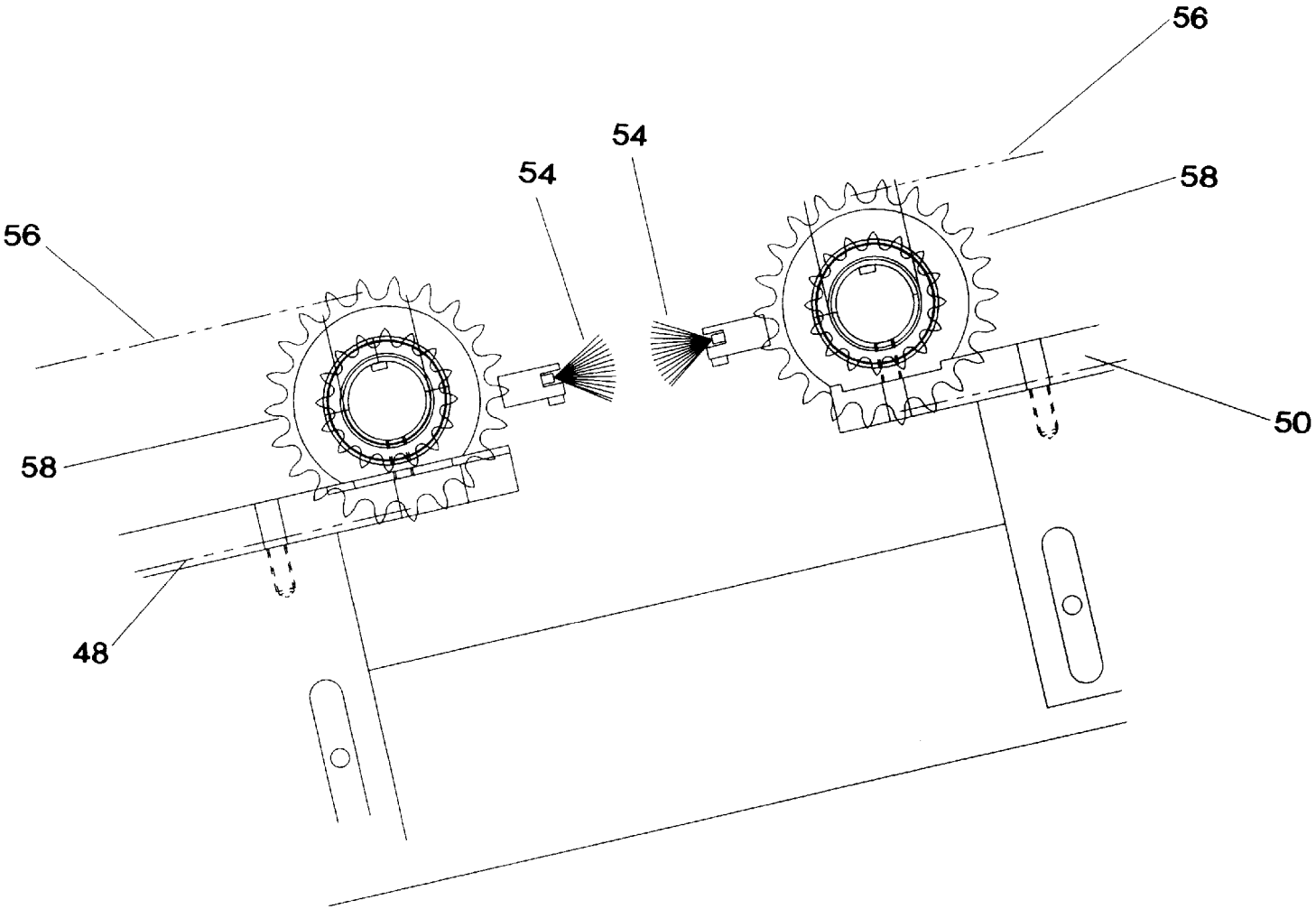
FIG. 6 shows an exemplary two brooms used to sweep the small items into pockets in the plates forming the orientation conveyor and to sweep the excess small items back toward the initial feed stream.

Conveyor 44 is oriented to incline upwardly at an angle of approximately 12°–15° (FIG. 4) with respect to the horizontal. This angle will be selected on a basis of the physical characteristics of the small items so that gravity tends to fill the pockets and to enable excess small items to slide back toward the fill location at metering wheel 42. Three conveyors 48, 50, 52 are positioned above conveyor 44. These conveyors may be selectively driven at different speeds, in opposite directions, or in the same direction, according to the needs for packaging the small items. Each of these conveyors carries a plurality of brushes 54 at equally spaced intervals. The brushes are attached to and carried by link chains 56 (FIG. 6) trained over sprocket wheels 58. By way of example, FIG. 6 shows two of these brushes 54 mounted on conveyors 48, 50, respectively.

The brushes 54 sweep (FIG. 4) away the small items which have not become lodged in the pockets 46. The act of sweeping also fills any empty pockets and moves any surplus small items back toward metering wheel 42. Between the conveyors 48, 50, paddle wheel 60, having relatively solid blades, is located to help clean out any debris of broken small items which may have become lodged in conveyor 44. For example, when the small items are candy coated chewing gum, the debris may be bits and parts of the candy coating broken away.

Near the end of conveyor 44, a rotary brush 62 extending across the width of conveyor 44 is positioned to sweep away everything that is not within the pockets 46. By now, there should not be anything on conveyor 44 except for the small items in the pockets 46 and every pocket should be filled by a properly oriented small item.

A diverter 64 (FIGS. 7 and 8) is located at the distal end of the conveyor 44 (i.e. opposite the loading end of the conveyor 44). The diverter is formed by a number of spaced parallel plates, such as 66, 68 (FIG. 8). The plates are close enough to form a space 70 which is too narrow to pass any small items that are correctly oriented and lodged in the pockets 46, but which is wide enough to pass debris laying on conveyor 44, and perhaps to pass any small items which are not correctly oriented in a pocket.

Figure 7:
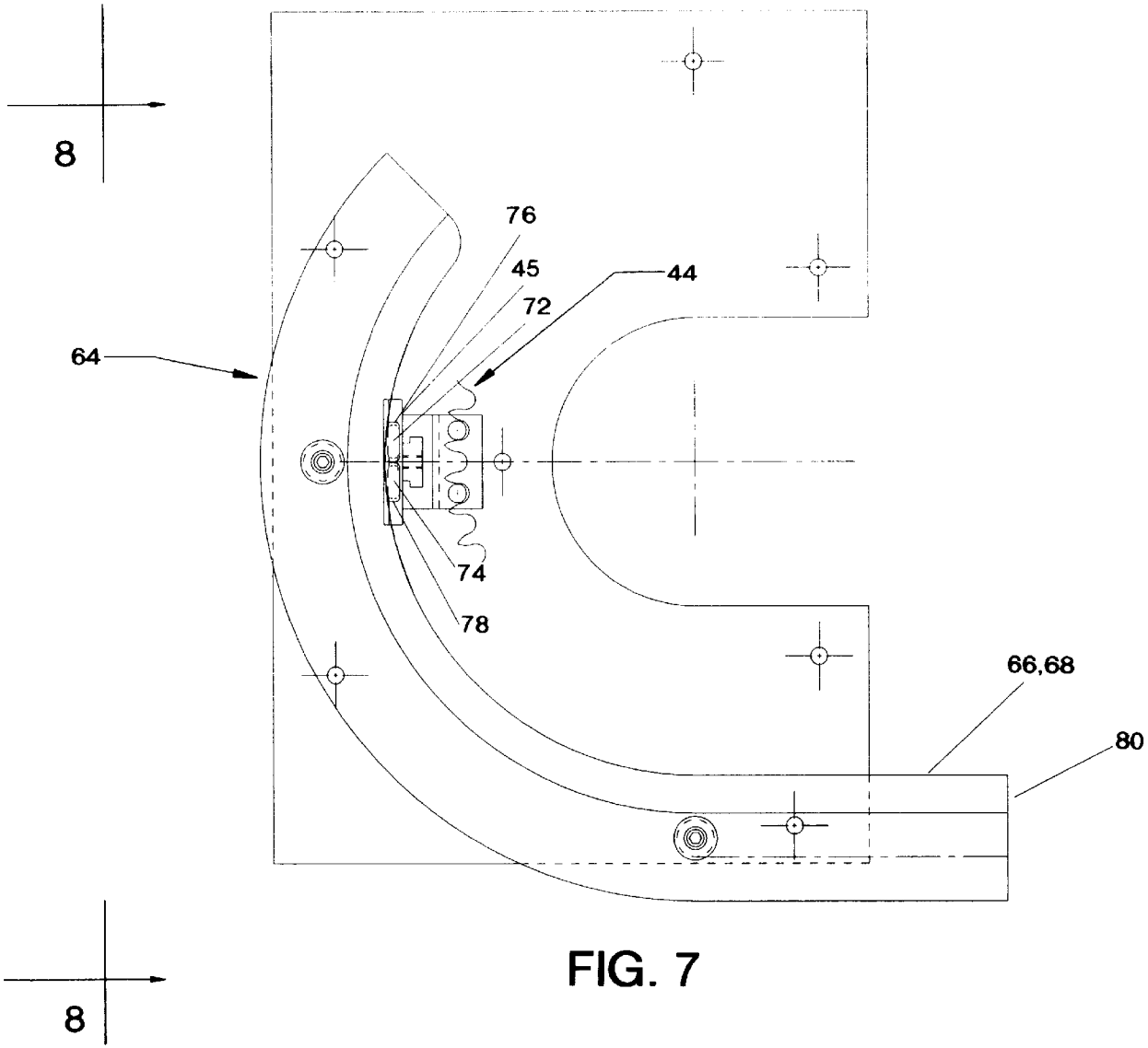
FIG. 7 shows a capture/deflector for capturing the small items in orientation pockets as a conveyor goes around a sprocket wheel.
Figure 8:
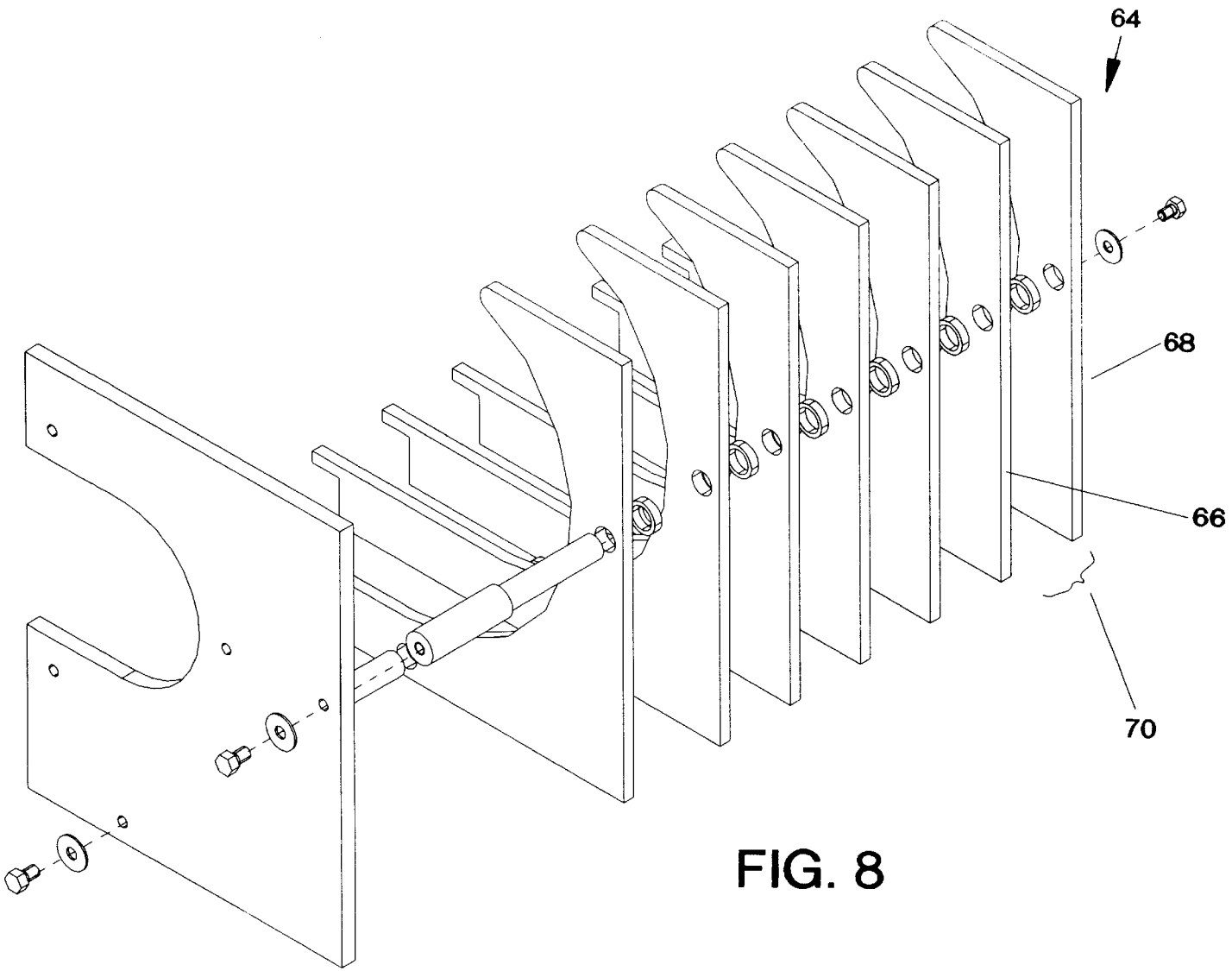
FIG. 8 is perspective, exploded view of the capture/deflector taken along line 8—8 of FIG. 7.

As best seen in FIG. 7, these spaced plates 66, 68 form a concave surface which is spaced closely enough to the conveyor 44 to keep the small items in the pockets 46 while they are inverted. By way of example, a single plate 45 of conveyor 44, is shown passing through the concavity of diverter 64. Two small items 72, 74 are shown as being captured in pockets 76, 78 by the spaced diverter plates 66, 68. All of the pocket plates 45 forming conveyor 44 travel past diverter 64 in a similar manner. After the conveyor 44 emerges from the diverter 64, the pocket plates 45 are inverted so that any remaining debris falls away while the small items continue to be held in place by a floor plate extending from the end 80 of the diverter plates 64 (FIG. 5).

Figures 10, 11:
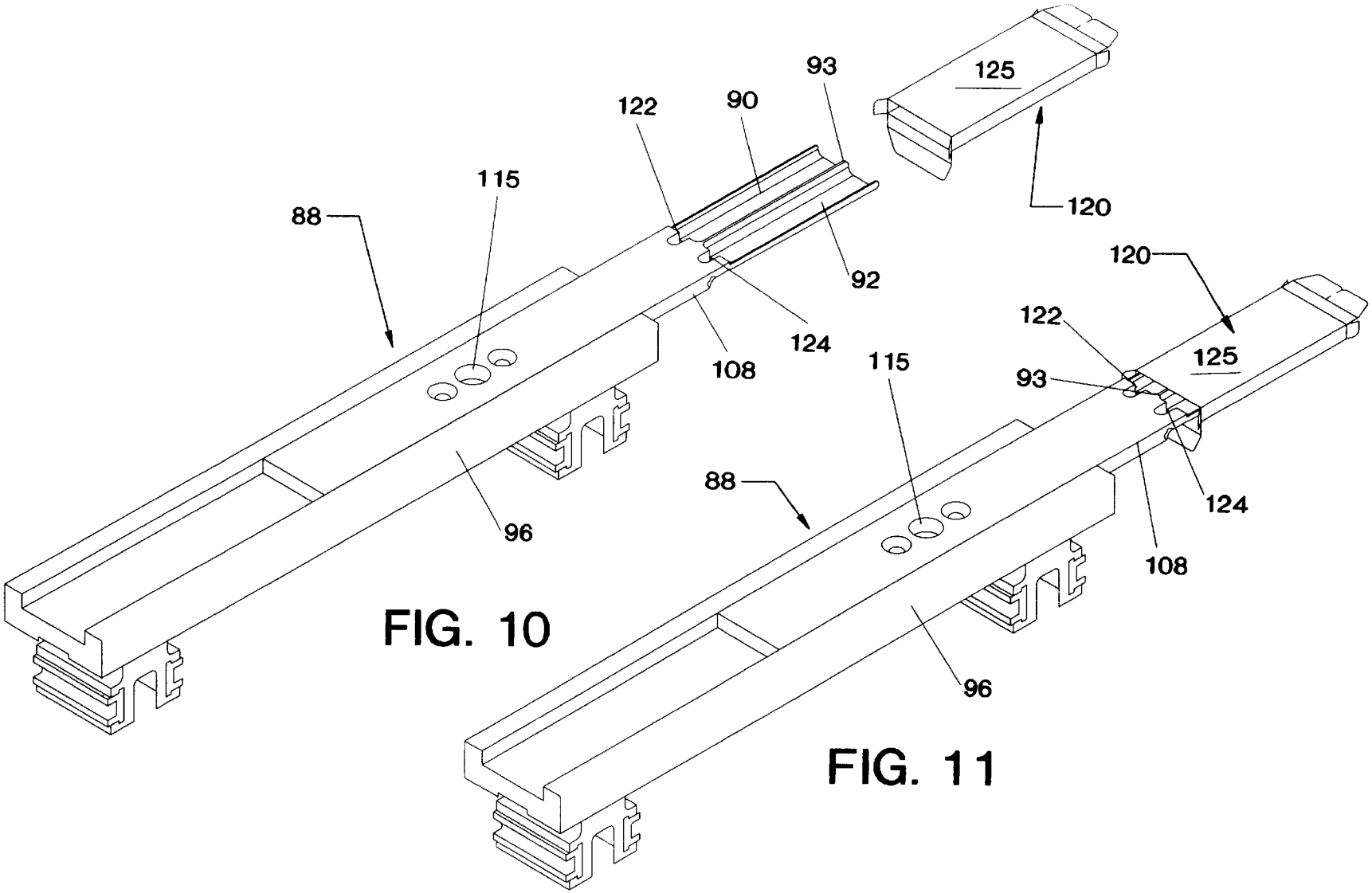
FIG. 10 is a perspective view of an insertion tray before insertion into a box.
FIG. 11 is the same as FIG. 9, but with the insertion tray extended into the box.

At the opposite end of conveyor 44, there is a common section 28 where the inverted pocket plates 45 travel over and in confronting alignment with a conveyor 82 made of joined insertion tray assemblies attached to link chains, such as insertion tray assembly 88. (FIGS. 9–11).

Figure 3A:
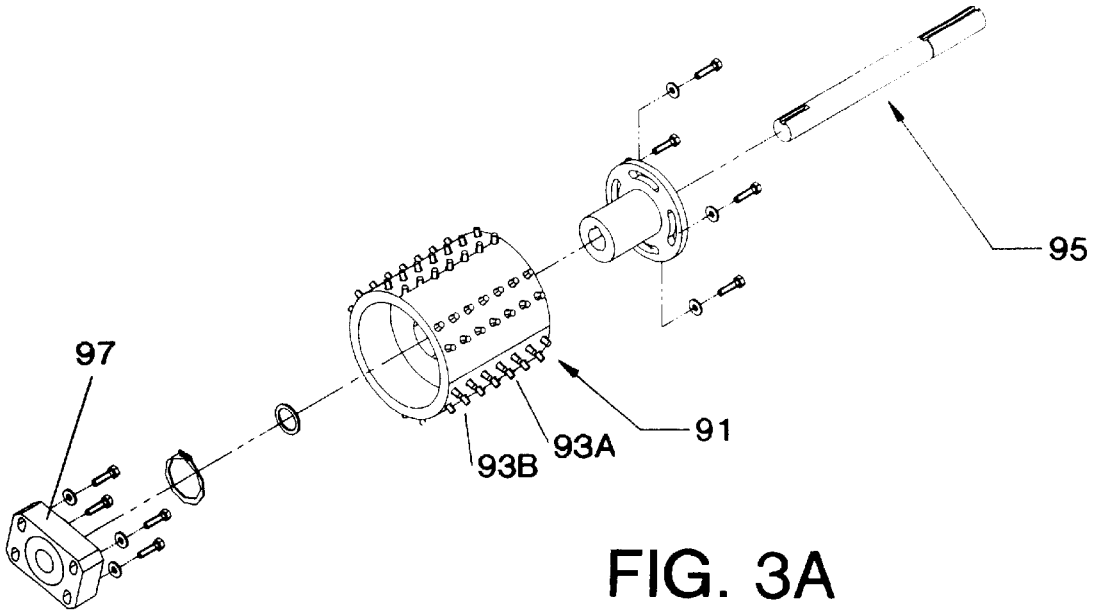
FIG. 3A is a perspective view of a device for pushing the small items out of pocket plates that carry them.
Figure 3B:
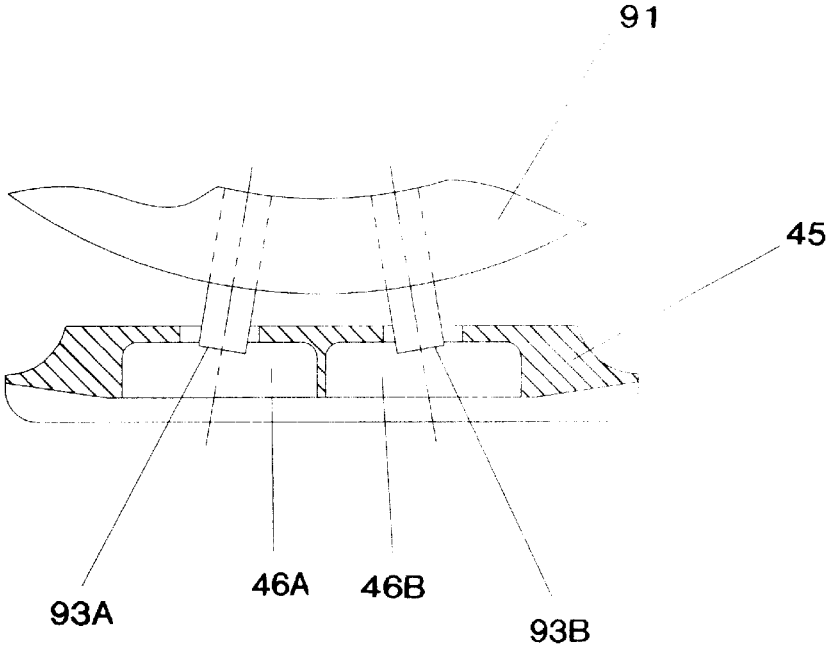
FIG. 3B is a cross sectional view of a pocket plate with an exemplary two pegs penetrating two pockets to insure a discharge of the small items therein.

FIGS. 3A and 3B show a wheel 91 having a plurality of aligned pegs 93 projecting from the surface thereof and being mounted on axle 95 which, in turn, is supported on bearings 97, 97. There are pairs of rows of pegs 93, with the spacing between undivided pegs corresponding to the spacing between the pockets 46 in plates 45. (FIG. 5). As the conveyor 44 carrys the pocket plates 45 under the wheel 91, each pocket is penetrated by one peg 93 in order to push the small item out of the pocket. For example, FIG. 3B shows pegs 93*a*, 93*b* penetrating pockets 46*a*, respectively.

Figure 9:
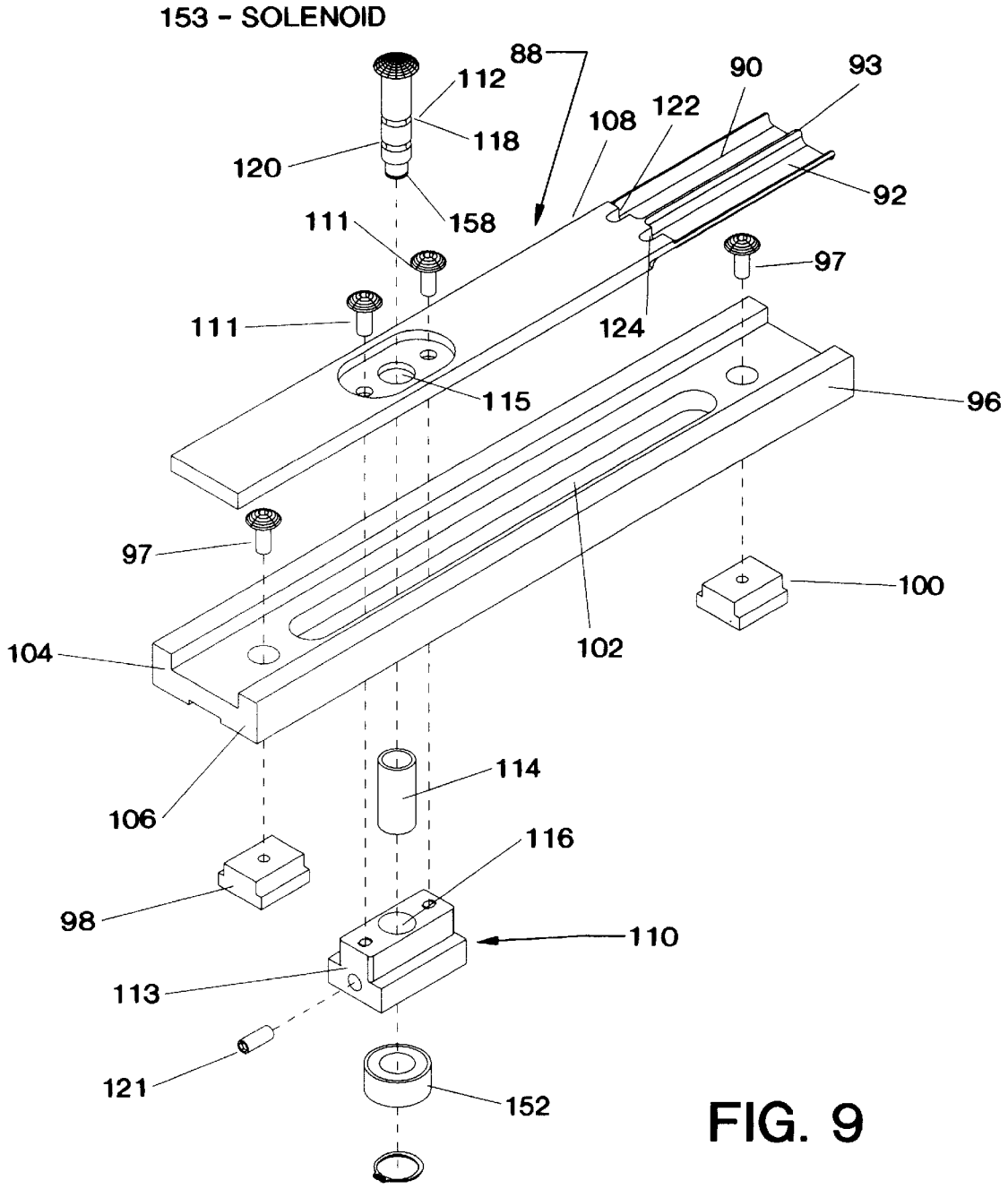
FIG. 9 is an exploded view of an insertion tray assembly.

The insertion tray assembly may be understood best by an inspection of FIGS. 9, which shows the major parts of the assembly as track section 96 and product insertion tray member 108. The track section 96 is attached to anchor means 98, 100 by bolts 97, which in turn facilitate an attachment of track section 96 to a link chains conveyor 82 (FIG. 4). The track section 96 has a centrally located elongated slot 102 flanked by opposed side walls 104, 106. The product insertion tray member 108 is a slide having dimensions which enable it to slide smoothly between side walls 104, 106 of the track section 96. A block 110 is attached to insertion tray slide member 108 by bolts 111 and has a section 113 which slides in and is guided by groove 102.

A "Smart Pin" is shown in FIG. 9, and elsewhere in the prior art as in FIGS. 5 and 6 of U.S. Pat. No. 4,856,566, for example. More particularly, pin 112 slides up and down in a bronze bearing 114 embedded in hole 115 of insertion tray member 108 and hole 116 of sliding block 110. Two circumferential grooves 118, 120 on "Smart Pin" 112 engage a spring biased detent 121 which holds the pin in either a raised or a lowered position.

FIG. 9A shows the product insertion tray slide member 108, in detail. The small items are carried in the two grooves 90, 92, for insertion into the carton. These specially designed product insertion trays provide the most effective and positive handling of the small items, such as "CHICLETS." However, trays with other configurations may be provided for loading other small items.

The product insertion trays 108 have grooves matching the 3-dimensional shape of "CHICLETS" or another small item. Further, the outside contour of the insertion tray 108 is matched to the inside dimensions of the carton 120 (FIG. 10). Hence, a three dimension contour on the outside of the insertion tray 108 assists in forming the recipient carton, which is squared responsive to an introduction of the insertion tray into the carton.

The center ridge 93 of the insertion tray 108 is higher than the remainder of the top surface of the insertion tray which goes into the carton. The raised ridge 93 forms the confronting top panel 125 of the carton into a crown shape for preventing the carton from causing a friction or interference with the orientation of the small items during their insertion into or from the carton.

FIG. 10 shows the insertion tray 108 in a retracted position on slide track 96 and confronting an open end of carton 120. The insertion tray 108 is filled with the proper number of small items. Then, it moves forward (FIG. 11) entering the carton 120, with ridge 93 slightly raising the top panel 125 thereof, and carrying with it the small items loaded in grooves 90, 92. Both the slide track 96 and product insertion tray 108 are shown at 38 (FIG. 1) as being extended toward the loading station 36.

It will be noted that each of the grooves 90, 92 (FIGS. 10, 11) on the insertion tray terminates in a cove 122 or 124. Suitable stripper fingers (seen at 121 in FIG. 4), which are carried by a conveyor belt 125, enter these coves 122, 124. Then, the insertion tray 108 is retracted from the position shown in FIG. 11 to the position shown in FIG. 10 while the stripper fingers preclude a removal of the small items from carton 120. This stripping action deposits the small items formerly in grooves 90, 92 into the carton 120. The fingers 121 are withdrawn from the coves by the retraction motion of insertion tray 108 as it leaves the small items in carton 120.

Stated another way, each of the insertion tray assemblies 88 (FIG. 9) follows a straight path along a conveyor section 82 (FIG. 3). In the conveyor section 38, where the product is to be inserted into the carton, the entire insertion tray assembly 88 is thrust forward. While in the forward thrust position, the filled product insertion tray 108 is moved by sliding on track 96 from the retracted position (FIG. 10) to the extended position (FIG. 11) and into carton 120. Next, empty insertion tray 108 is withdrawn from the carton and returned to the retracted position of FIG. 10. Thereafter, the entire insertion tray assembly 88 is returned from the forward thrust position shown at 38 in FIG. 3. The forward thrust and return movement of the insertion tray assembly 88 is controlled by a "Smart Pin" 127. The movement of product insertion tray 108 on track 96 is controlled by another "Smart Pin" 112 (FIG. 9).

Figure 13:
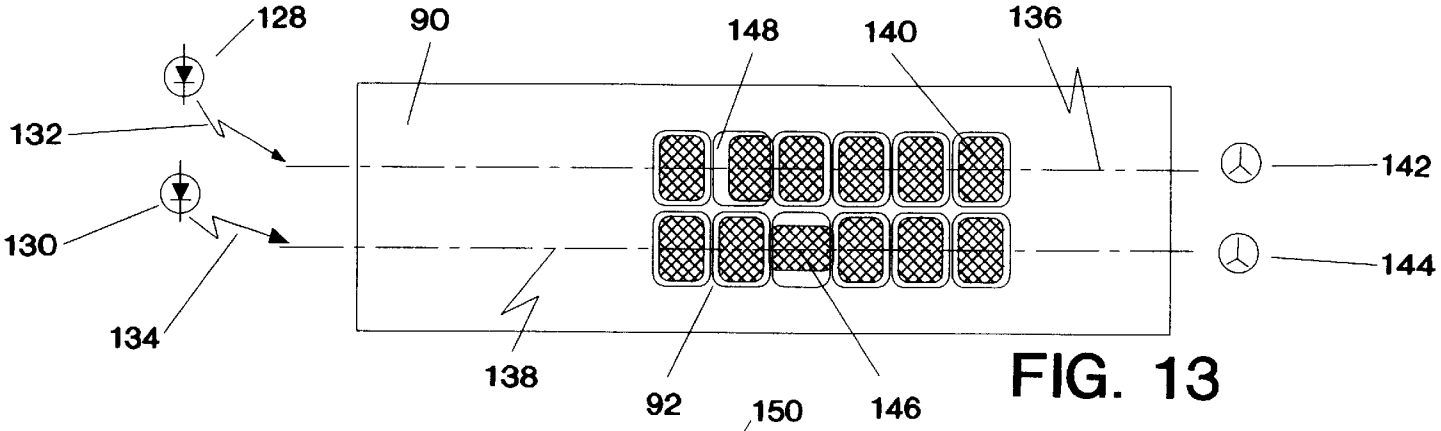
FIGS. 13 and 14 schematically show a photo detection of a full load of properly oriented small items in the insertion tray.
Figure 14A:
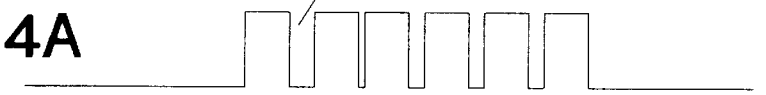
Figure 14B:
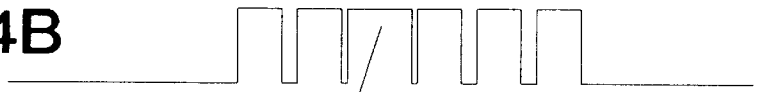
Figure 12:
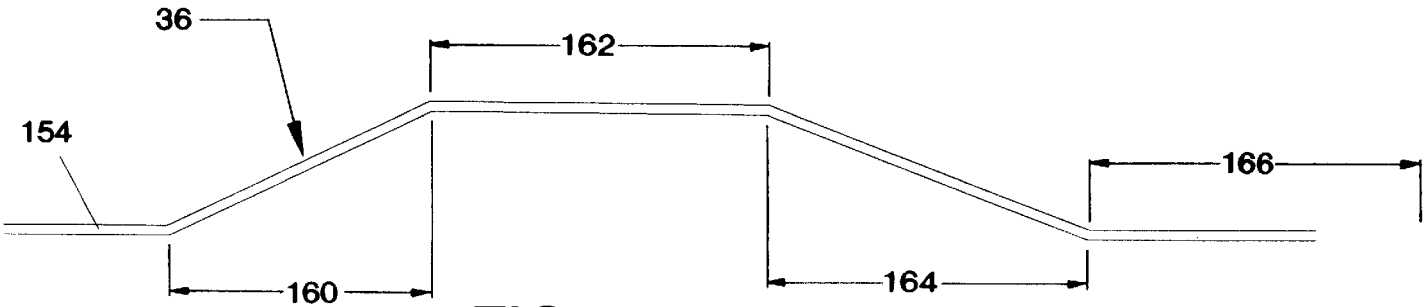
FIG. 12 shows a cam track or groove which causes the insertion tray to be extended or not extended.

At any suitable and convenient point upstream of the insertion position 36 (FIG. 1), a sensor 30 (FIGS. 3, 4, 12, 13) detects whether the grooves 90, 92 are filled with the proper numbers of small items, such as shown at 140, 146 (FIGS. 13, 14). This sensor 30 includes light emitting diodes 128, 130 (FIG. 13) which direct narrow beams of light 136, 138 at the small items.

Here, the small items are shown as "CHICLETS" candy coated chewing gum, such as 140, for example, which have a white candy coating that reflects light. The light reflected from each of the "CHICLETS" gum pieces is picked up by a photo cell 142, 144. The output from each of the photo cells 142, 144 is a train of pulses, as shown in FIGS. 14(A and B). Each individual pulse is generated by reflections from an individual one of the "CHICLETS" in each of the grooves 90, 92.

Although they are generally uniformly shaped and spaced rectangular objects, FIG. 13 has been deliberately drawn to show that, as the small item, the "CHICLETS" pieces may be irregularly shaped, randomly spaced and perhaps skewed in the grooves. For example, FIG. 13 has been drawn to show that one "CHICLET" 146 has been oriented in a position rotated about 90° (more or less) relative to the remaining "CHICLETS." These random event are reflected in the pulse trains of FIGS. 14A and 14B. Thus, for example, the large gap 148 (FIG. 13) between two "CHICLETS" causes a corresponding wide space 150 between two pulses in the output of photocell 142. Likewise, the cross ways "CHICLET" 146 produces a corresponding wide pulse 152 in the output of photocell 144.

The point is that the only requirement of the sensor 30 is that the pulses must be suitable for counting. Thus, the automatic packaging machine counts the pulses of FIGS. 14(A and B) and knows that there will be two rows, each having six "CHICLETS" in each row, and further that two "CHICLETS" will be side-by-side when tray 108 is inserted into the carton.

As the insertion tray 108 approaches the sensor 30, the "Smart Pin" 112 (FIGS. 3 and 9) is in a raised position. If the trains of pulses produced by photocells 142, 144 (FIG. 13) do not have the correct and desired number of pulses, the pin 112 is left in the raised position where it is held by spring loaded detent 121 (FIG. 9) resting in circumferential groove 120. On the other hand, if each of the pulse trains from the photocells have the proper number of pulses, the sensor triggers a solenoid 153 (FIG. 9). The "Smart Pin" is then pushed down 112 so that detent 121 snaps out of groove 120 and into groove 118 to hold the pin 112 in the down position.

Figure 1A:
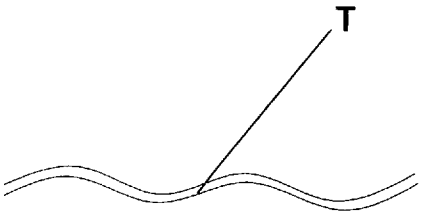
FIG. 1A shows an undulating cam track for shaking the small items into position prior to loading them into the cartons.

While in the down position, the pin 112 follows a cam track 154 (FIG. 12) which is in the insertion area 36 (FIG. 3) of the conveyor. In greater detail, a bearing or wheel 156 (FIG. 9) is attached to the bottom 158 of the pin 112 so that it may roll within and along the cam track 154. In the region 160 of the cam track, rolling bearing 156 moves the insertion tray 108 outwardly and into a loading position (as shown in FIG. 3) and in the carton 120 (FIG. 11). In the region after the small items are loaded into insertion tray 92 and before they reach the carton 120, the cam track T (FIG. 1A) for smart pin 112 is undulating to vibrate the insertion tray 92 enough to shake the small item into this desired loading position.

In the region 162 of the cam track (FIG. 12), the stripping fingers 38 (FIG. 2) enter the coves 122, 124 (FIG. 11). In the region 164 of the cam track, the rolling bearing 156 pulls the insertion tray 108 out of the carton 120 and back to the retracted position of FIG. 10.

In the region 166 of the cam track, the floor of the cam track slopes upwardly to raise the "Smart Pin" 112 to its elevated position in preparation for the next time that the conveyor presents an associated insertion tray 108 to the sensor 30. Detent 121 (FIG. 9) snaps into groove 120 to hold pin 112 in the elevated position.

In its present form, the automatic packaging machine can fill up to approximately 500 cartons (6000 "CHICLETS") per minute.

Those who are skilled in the art will perceive modifications which may be made in the invention. Therefore the appended claims should be construed to cover all equivalent structures falling within the scope and spirit of the invention.

The claimed invention:

1. An automatic packaging machine comprising a plurality of spaced parallel pocket plates forming a first endless conveyor, each of said pocket plates having therein a plurality of pockets arranged in columns and rows to hold small items in a pattern corresponding to a desired orientation of said small items in a container, means for removing any debris and excess small items not resting in a pocket away from on said pocket plate, a plurality of insertion trays forming a second endless conveyor, each of said insertion trays having holding means corresponding to individually associated ones of said columns of said pockets, means for bring said pocket plates and insertion trays into a face-to-face relationship and moving said small items from said pockets and into said holding means, means for selectively moving said insertion tray with said small items remain in said holding means into a container, and stripping means for withdrawing said insertion tray from said container while preventing said small items from leaving said container as said insertion tray is removed therefrom, whereby said small items remain in said desired orientation within said container.

2. The machine of claim 1 and means for removing debris from said pocket plates so that said small items are inserted into said container are free of said debris.

3. The machine of claim 1 wherein said means for removing debris and excess small items are at least one brush conveyor positioned over said pocket plates for sweeping said pocket plates.

4. The machine of claim 3 wherein there are a plurality of said brush conveyors, and means for independently driving each of said brush conveyors so that they may be selectively driven in alternative speeds and directions.

5. The machine of claim 1 and means for counting said small items on said insertion trays, means responsive to a correct count for selectively causing said moving of said insertion tray into said container, and means responsive to an incorrect count for selectively precluding said moving of said insertion tray into said container.

6. The machine of claim 5 wherein said counting means comprises means for directing light onto said small items while on said insertion tray and for detecting the light reflected from said small items.

7. The machine of claim 5 wherein said holding means comprises a pair of grooves on said insertion tray matching said columns of said small items, and said stripping means comprises a finger positioned in the root of each of said grooves for blocking a removal of said small item from said container as said insertion tray is removed from the container.

8. The machine of claim 5 and a pin having up and down positions, means responsive to a correct count for positioning said pin in a first of said positions, means responsive to an incorrect count for positioning said pin in a second of said positions, and a cam track followed by said pin in only one of said positions for controlling said moving and said insertion tray, whereby said means for selectively moving and said means for precluding the moving of said insertion tray.

9. The machine of claim 1 wherein said small item is candy coated chewing gum.

10. The machine of claim 1 and means for removing said debris from said pocket plates with out disturbing said small items in said pockets while said pocket plates are moving toward said insertion trays.

11. The machine of claim 10 wherein said means for removing said debris comprises at least one brush sweeping said pockets.

12. The machine of claim 10 wherein said means for removing said debris comprises open bottoms in said pockets.

13. The machine of claim 10 wherein said means for removing said debris comprises means for inverting said pocket plates while holding said oriented small items in said pockets.

14. The machine of claim 1 wherein each of said pockets has an opening in the bottom thereof, and said means for moving said small items from said pockets to said holding means comprises means for penetrating said opening to push said small items out of said pockets.

15. The machine of claim 1 wherein each of said insertion trays comprises an elongated plate having outside shape and dimensions which fit into said container, said container having a shape corresponding and complementary to the shape and dimensions of said container, whereby said insertion tray shapes said container while therein, a surface on said tray having thereon a groove corresponding to each column for carrying said small items, and a raised ridge associated with said grooves for lifting a side of said container which confronts said small items, whereby a crown is formed on said side so that there is substantially no friction between said small item and the lifted side during said moving of said insertion tray into and out of said container.

16. The machine of claim 1 wherein the means for selectively moving the insertion trays into said carton comprises means for so moving said insertion trays with undulating motion.

17. An automatic packaging machine comprising means for feeding small items into a loading position, means for arranging the small items in a desired orientation, insertion tray means for inserting said small items into a carton, means for laying said oriented small items from said arranging means onto said insertion tray means while maintaining said desired orientation, and means for withdrawing said insertion tray means from said carton while blocking a removal of said small items, whereby said small items are laid down in said desired orientation inside said carton.

18. The machine of claim 17 wherein said insertion tray means has at least one groove on a surface thereof, said small items laying in said at least one groove during said insertion of said tray means into a carton, and a ridge on said surface and parallel to said groove for raising a side of said carton adjacent said small items so that there is substantially no friction between said raised side and said small items in said groove during said insertion.

19. The machine of claim 18 wherein said surface of said insertion tray means has at least two of said grooves in a spaced parallel relationship, said ridge being positioned between said at least two of said grooves.

20. The machine of claim 17 wherein said arranging means comprises a grid structure defining a plurality of individual openings into each of which an individual one of said small items fits.

21. The machine of claim 20 and brush means for sweeping said small items into individually associated ones of said openings and for sweeping excess ones of said small items off said surface of said tray means.

22. The machine of claim 21 wherein said insertion tray means has grooves which conform to locations of said openings so that said small items may be transferred from said grid structure to said grooves without disturbing said desired configuration.

23. The machine of claim 22 and means for moving said small items in said insertion tray with an undulating motion for shaking them into a desired orientation.

24. The machine of claim 22 and a ridge adjacent said grooves for lifting a side of said carton while said tray means is in said carton.

25. The machine of claim 22 and a source of light for illuminating said small items, photodetector means for sensing said light reflected from said small items, and means responsive to said photo detector for activating or blocking said insertion of said tray means into said carton whereby said small items are inserted into said carton only when there is a correct number of said small items in said tray means.

26. The machine of claim 17 wherein said means for laying said small items on said insertion tray comprises a plurality of spaced parallel plates which hold said small items in said arranging means while said arranging means is inverted, means for bringing said inverted arranging means into face-to-face confrontation with said insertion tray means, said parallel plates being spaced closely enough to hold said small items in said desired orientation and spaced wide enough for debris to fall off said arranging means while in said inverted position.

27. The machine of claim 20 wherein said grid structure comprises a plurality of pockets, each of said pockets comprising a frame with an open bottom, said frame being configured to capture a small item while enabling debris to fall out said open bottom.

28. The machine of claim 27 and means for penetrating said open bottom during an unloading of said pockets for insuring a dislodging of a small item therefrom.

* * * * *